US009226574B1

(12) United States Patent
Chen

(10) Patent No.: US 9,226,574 B1
(45) Date of Patent: Jan. 5, 2016

(54) FOLDABLE MULTI-SHELF STAND

(71) Applicant: Protrend Co., Ltd., Taipei (TW)

(72) Inventor: Shun-Yi Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 14/527,874

(22) Filed: Oct. 30, 2014

(30) Foreign Application Priority Data

Sep. 23, 2014 (TW) ..... 103216862 U

(51) Int. Cl.

| | |
|---|---|
| ***A47F 5/08*** | (2006.01) |
| ***A47B 43/00*** | (2006.01) |
| ***A47B 96/02*** | (2006.01) |
| ***A47B 96/07*** | (2006.01) |

(52) U.S. Cl.
CPC ..... *A47B 43/00* (2013.01); *A47B 96/021* (2013.01); *A47B 96/07* (2013.01)

(58) Field of Classification Search
CPC ..... A47B 43/00; A47F 5/13
USPC ..... 211/201, 204, 196, 200, 149, 85.3
See application file for complete search history.

(56) References Cited

U.S. PATENT DOCUMENTS

| | | | | | |
|---|---|---|---|---|---|
| 604,875 | A | * | 5/1898 | Canedy | 211/36 |
| 1,167,550 | A | * | 1/1916 | Forsyth | 108/163 |
| 1,198,431 | A | * | 9/1916 | Forsyth | 108/163 |
| 1,304,847 | A | * | 5/1919 | Blais et al. | 108/163 |
| 1,612,937 | A | * | 1/1927 | Mitchell | 108/59 |
| 2,249,234 | A | * | 7/1941 | Srodulski | 312/42 |
| 2,938,632 | A | * | 5/1960 | Mondineu | 108/106 |
| 3,093,247 | A | * | 6/1963 | Erickson | 108/188 |
| 3,212,605 | A | * | 10/1965 | Dickerson | 182/119 |
| 4,450,971 | A | * | 5/1984 | Kashiwabara | 211/201 |
| 4,740,010 | A | * | 4/1988 | Moskovitz | 280/641 |
| 5,131,547 | A | * | 7/1992 | Goldberg | 211/149 |
| 6,123,207 | A | * | 9/2000 | Mast | 211/149 |
| 6,213,494 | B1 | * | 4/2001 | Liaw | 280/651 |
| 6,334,400 | B1 | * | 1/2002 | Nien | A47B 3/087 108/115 |
| 6,685,199 | B2 | * | 2/2004 | Stravitz et al. | 280/42 |
| 6,851,564 | B2 | * | 2/2005 | Ng | 211/149 |
| 6,976,596 | B2 | * | 12/2005 | Brooks | 211/153 |
| 7,080,640 | B2 | * | 7/2006 | Sanders et al. | 126/30 |
| 7,637,220 | B2 | * | 12/2009 | Fu | 108/163 |
| RE41,763 | E | * | 9/2010 | Ng | 211/149 |
| 8,109,526 | B2 | * | 2/2012 | Mason et al. | 280/47.35 |
| 8,672,147 | B2 | * | 3/2014 | Lam | 211/149 |
| 2004/0238469 | A1 | * | 12/2004 | Ng | 211/149 |

* cited by examiner

*Primary Examiner* — Joshua Rodden
*Assistant Examiner* — Kimberley S Wright
(74) *Attorney, Agent, or Firm* — WPAT, PC; Justin King

(57) ABSTRACT

A foldable multi-shelf stand includes two frame structures, a plurality of foldable storage shelves located in a pivotal manner between the two frame structures, a plurality of fixation mechanisms for controlling the folding of the corresponding storage shelves and at least one supportive member. Each the frame structure has a plurality of vertical columns and a plurality of horizontal beams connected with the respective vertical columns. The storage shelf is separated to two foldable halves and consisted of a plurality of foldable first-directional horizontal members. The fixation mechanism mates the corresponding plug hole structure at the respective half of the storage shelf so as to perform the folding control of the corresponding storage shelf. The supportive member located to a respective connection place of the first-directional horizontal member and the frame structure is to support the unfolded first-directional horizontal member at the respective vertical columns.

7 Claims, 6 Drawing Sheets

FOLDABLE MULTI-SHELF STAND

This application claims the benefit of Taiwan Patent Application Serial No. 103216862, filed Sep. 23, 2014, the subject matter of which is incorporated herein by reference.

BACKGROUND OF INVENTION

1. Field of the Invention

The invention relates to a storage stand, and more particularly to a foldable multi-shelf stand and the same foldable multi-shelf stand with wheels.

2. Description of the Prior Art

The storage stand or the multi-shelf stand is a simple storage tool in daily life. The multi-shelf stand is usually frame-structured to have a plurality of storage shelves for miscellaneous collection of goods. Currently in the marketplace, the storage shelves of the storage stand are separately and movably arranged in a symmetric manner with respect to a common centerline. While the storage stand is in a off-service state, it usually can be disassembled or folded so that the occupied space can be reduced to a minimum. Nevertheless, for most of the current storage stands, a reassembled or unfolded stand generally has less structural strength so that the load capacity thereof is reduced due to its reduced structural stability by compared to a new stand. To improve the structural stability, several supportive frames or back ribs are generally applied so as able to amend the reduced load capacity to some extent. However, the introduction of the supportive frames or back ribs would somehow affect the storage convenience of the stand, and thus causes discomfort to the users.

SUMMARY OF THE INVENTION

Accordingly, it is the primary object of the present invention to provide a foldable multi-shelf stand and the same foldable multi-shelf stand with wheels, by either of which the aforesaid problem of the necessity to introduce the supportive members or back ribs for reinforcing a reassembled stand in both structural stability and load capacity can be resolved.

In the present invention, the foldable multi-shelf stand comprises:

two frame structures;

a plurality of storage shelves, each of which is separated to two foldable halves, two opposing ends of the storage shelf being pivotally connected to the two frame structures; and a plurality of fixation mechanisms, each of which is to mate corresponding plug hole structures constructed respectively at the two halves of each the storage shelf, the fixation mechanism being engaged/disengaged the corresponding plug hole structure at the respective half of the foldable storage shelf so as to inhibit/allow folding of the storage shelf.

In one embodiment of the present invention, the storage shelf further includes a plurality of horizontal members consisted of a plurality of foldable first-directional horizontal members, two ends of each the first-directional horizontal member being pivotally connected to the respective frame structures The foldable first-directional horizontal member is structurally separated into two sides, and two of the plug hole structures are constructed along the first direction to the respective sides of the foldable first-directional horizontal member. While the first-directional horizontal member is unfolded, the two fixation mechanisms mate the two plug hole structures, respectively.

In one embodiment of the present invention, the foldable multi-shelf stand further includes a connector mechanism consisted of a first connection member and a second connection member. The first connection member and the second connection member are mounted to the two sides of the fordable first-directional horizontal member, respectively. The first connection member is riveted to the second connection member. The two plug hole structures are located to the first connection member and the second connection member, respectively.

In one embodiment of the present invention, the first-directional horizontal member further includes a bottom plate and a lateral plate formed by bending up lateral sides of the bottom plate, and thus an accommodation room is formed between the bottom plate and the lateral plate. The first connection member and the second connection member are individually fixedly connected with the lateral plates of the corresponding two sides of the first-directional horizontal member, respectively. The two plug hole structures are nested inside the corresponding accommodation rooms of the corresponding first and second connection members.

In one embodiment of the present invention, each of the first connection member and the second connection member includes a fixation portion and a connection portion bent up from two lateral sides of the fixation portion. The fixation portion is to contact the bottom plate of the respective side of the foldable first-directional horizontal member, while the connection portion is fixedly connected to the lateral plate of the respective side of the foldable first-directional horizontal member. The connection portion of the first connection member and the connection portion of the second connection member are riveted together. The plug hole structure is constructed to the respective fixation portion.

In one embodiment of the present invention, the frame structure further includes a plurality of vertical columns and a plurality of horizontal beams connected with the plurality of the vertical columns A supportive member located to a respective connection place of the first-directional horizontal member and the frame structure is to support the unfolded first-directional horizontal member at the respective vertical columns.

In one embodiment of the present invention, the storage shelves are separately and parallel arranged between the two frame structures.

In one embodiment of the present invention, the foldable multi-shelf stand further includes a roof shelf hinged at one end to one top of one of the two frame structures, while another end thereof is rested freely and flush with one top of another one of the two frame structures.

In one embodiment of the present invention, the fixation mechanism further includes a plug portion and a restraint portion, the restraint portion being angularly connected with the connection portion. While the first-directional horizontal member is unfolded, the plug portion engages the plug hole structure and the restraint portion contacts the plug hole structure. A portion of the foldable first-directional horizontal member is constructed with a sliding slot for exposing the restraint portion through the first-directional horizontal member. The restraint portion can then slide along the sliding slot within a stroke of engaging and disengaging the plug hole structure.

In the present invention, the foldable multi-shelf stand can further include a plurality of wheels mounted to bottoms of the two frame structures.

By providing the foldable multi-shelf stand and the foldable multi-shelf stand with wheels in accordance with the present invention, the foldable first-directional horizontal members and the second-directional horizontal member can be pivotally connected to the respective vertical columns, the two plug hole structures can be constructed to discrete sections of the first-directional horizontal member along the first direction. As the first-directional horizontal member is unfolded, the fixation mechanism thereon can mate the corresponding plug hole structure, such that the foldable first-directional horizontal member can be fixed in position without any help from the supportive frame or the back ribs and without trading-off the load capacity, structural simplicity and the application convenience.

All these objects are achieved by the fordable multi-shelf stand and the same stand with wheels described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a fordable multi-shelf stand and the same stand with wheels. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
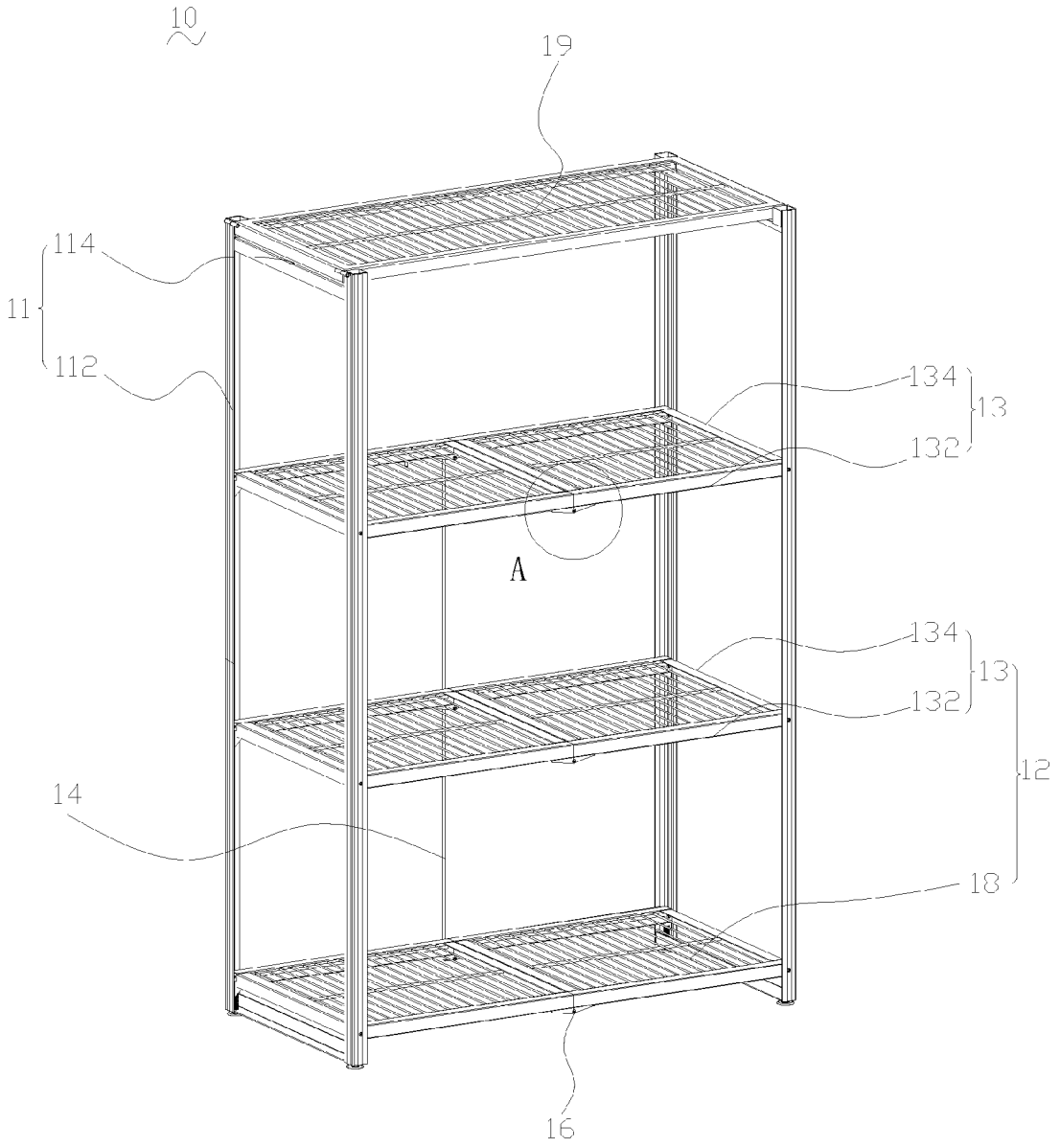
FIG. 1 is a schematic perspective view of a preferred embodiment of the foldable multi-shelf stand in accordance with the present invention.
Figure 2:
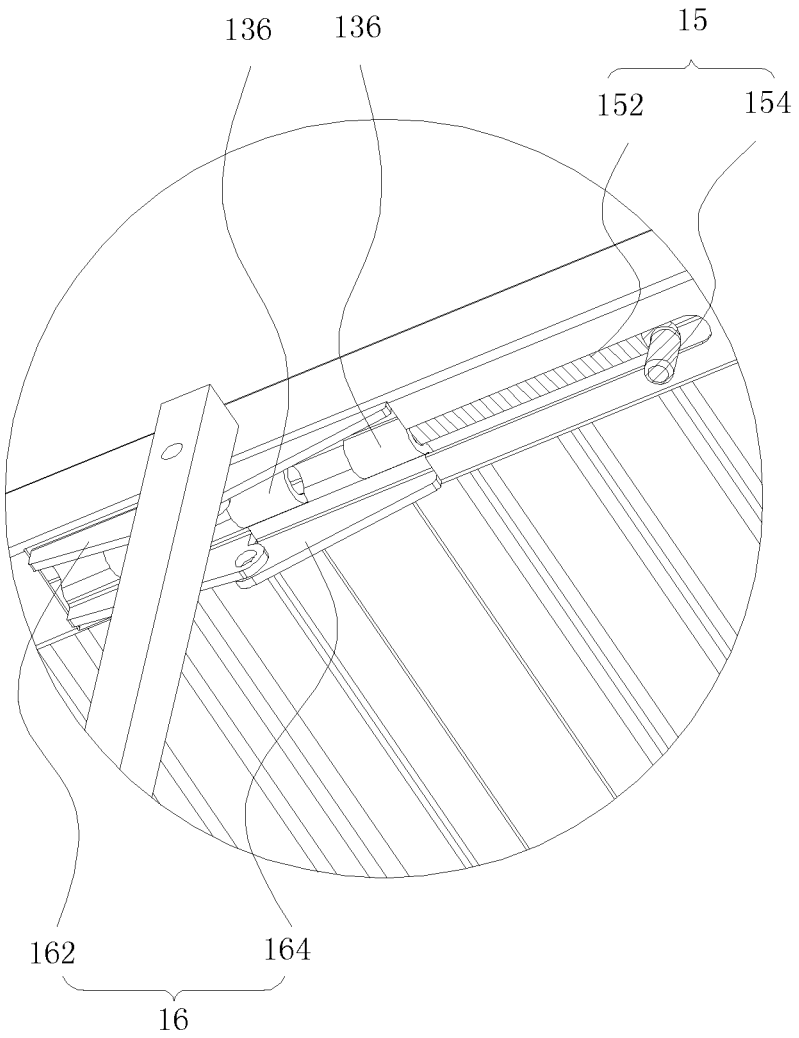
FIG. 2 is an enlarged view of circle A of FIG. 1.

Referring now to FIG. 1 and FIG. 2, the preferred embodiment of the foldable multi-shelf stand 10 in accordance with the present invention includes two frame structures 11, a plurality of storage shelves 12 (four shown in the figure, including the roof shelf) and a plurality of fixation mechanisms 15 (four shown in the figure, and one for each corresponding shelf). Each of the storage shelves 12 is consisted of two foldable halves to be integrated by hinging. Specifically, these two halves are hinged together at the middle line of the stand. The outer ends of the two halves of each storage shelf 12 are hinged to the corresponding frame structures 11. At each foldable half of the storage shelf 12, a plug hole structure 136 is constructed. In the case that the storage shelf 12 is unfolded, the corresponding fixation mechanism 15 would move to engage the plug hole structure 136 so as to fix the unfolded state of the two halves of the storage shelf 12. In the case that the storage shelf 12 is to be folded, the fixation mechanism 15 is retrieved, i.e. separated, from the plug hole structure 136 so as to allow the storage shelf 12 to be folded.

Figure 4:
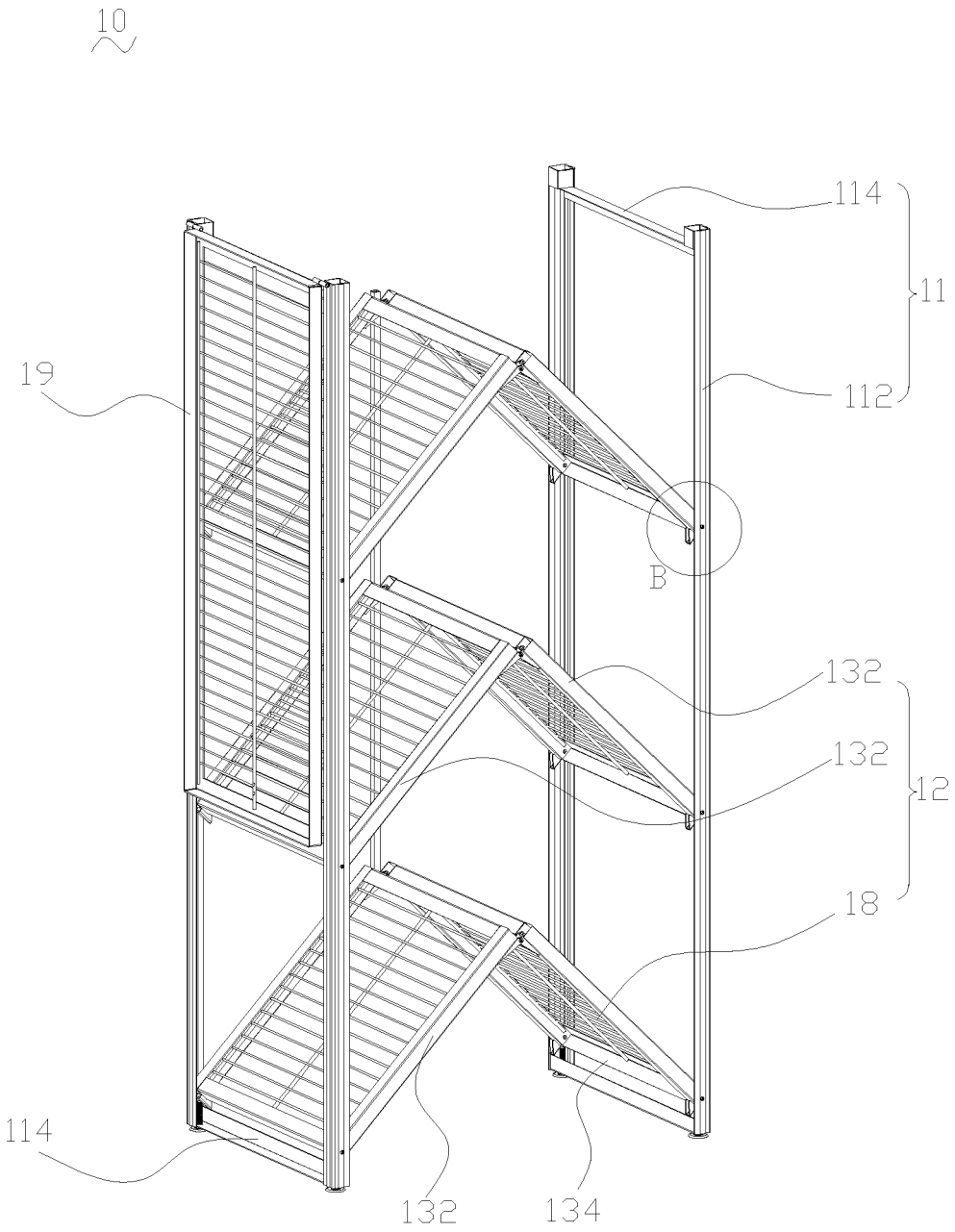
FIG. 4 is another state of FIG. 1, in which the foldable multi-shelf stand is folding.

The frame structure 11 includes two vertical columns 112 and two horizontal beams 114 to connect the two vertical columns 112 so as to form fixedly a square frame structure 11 (as shown in FIG. 4). In this embodiment, when the foldable multi-shelf stand 10 is in a folded state, these two originally-separate frame structures 11 are collapsed together.

It can be understood that the number of the vertical columns 112 and the number of the horizontal beams 114 are determined per requirements. For example, the number of the vertical columns 112 can be 3 or more. The vertical column 112 and the horizontal beam 114 can be hollow structures that are featured in light weight, good movability, and less material cost.

Figure 5:
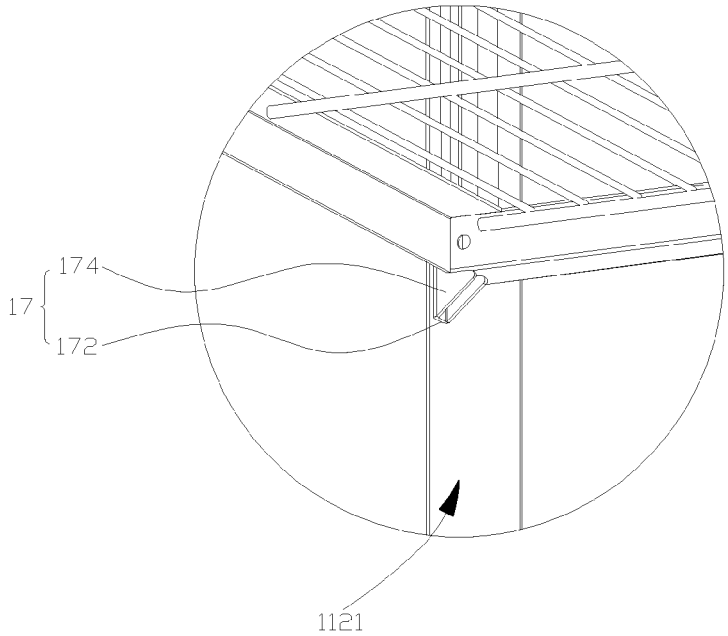
FIG. 5 is an enlarged view of circle B of FIG. 4.

Further, as shown in FIG. 5, the vertical column 112 is made from a plate material and having a receiving portion 1121. In this exemplary embodiment, the vertical column 112 is formed by a plate material bent into an L-shape cross section and thus provides the receiving portion 1121 at the concave 90° portion of the bent material.

Referring to FIG. 1 and FIG. 2, each of the storage shelves 12 includes a plurality of horizontal members 13 and the horizontal members 13 is further consisted of a plurality of first-directional horizontal members 132 (two shown in this embodiment) and a plurality of second-directional horizontal members 134 (two shown in this embodiment). Both the first-directional horizontal member 132 and the second-directional horizontal member 134 can be pivotally connected to the vertical column 112. In particular, the first-directional horizontal member 132 is foldable at a middle point thereof so as to separate the aforesaid two halves of the storage shelf 12. Two aforesaid plug hole structures 136 can be constructed individually to two sides of the foldable first-directional horizontal member 132. In the case that the first-directional horizontal member 132 is in a unfolded state, the respective fixation mechanism 15 can engage the plug hole structure 136 so as to hold fixedly the unfolded state of both the storage shelf 12 and the first-directional horizontal member 132. Preferably, the first-directional horizontal member 132 is symmetrically constructed with respect to its middle foldable point.

In the preferred embodiment, the first-directional horizontal member 132 is pivotally connected with the vertical column 112 by riveting, and also the second-directional horizontal member 134 is pivotally connected with the vertical column 112 by riveting. Preferably, the riveting of the first-directional horizontal member 132 and that of the second-directional horizontal member 134 are co-axial so that the first-directional horizontal member 132 and the second-directional horizontal member 134 can be formed into the same planar frame structure. Upon such an arrangement, objects loaded on the storage shelf 12 formed by the first-directional horizontal member 132 and the second-directional horizontal member 134 can be stable away from possible slipping away. Alternatively, the first-directional horizontal member 132 and the second-directional horizontal member 134 can be also hinged to the vertical column 112, so that the first-directional horizontal member 132 can perform folding and unfolding in the first direction.

Referring to FIG. 2, the foldable multi-shelf stand 10 further includes a connector mechanism 16 having a first connection member 162 and a second connection member 164. The close ends of the first connection member 162 and the second connection member 164 are hinged together, while the distant ends of the first connection member 162 and the second connection member 164 are located to respective halves of the foldable storage shelf 12, namely to opposing sides of the foldable first-directional horizontal member 132. Upon such an arrangement, the first-directional horizontal member 132 can be foldable. Preferably, the aforesaid plug hole structures 136 can be constructed at the first connection member 162 and the second connection member 164, respectively.

In the case that the foldable multi-shelf stand 10 is to be stored, the two frame structures 11 are pushed inward so as to rotate the first connection member 162 and the second connection member 164 in an overlapping manner. Simultaneously, the first-directional horizontal member 132 is bent between the two vertical columns 112. Then, the folding of the foldable multi-shelf stand 10 can be achieved. On the other hand, in the case that the foldable multi-shelf stand 10 is to be unfolded, these two frame structures 11 are pulled away, then the first connection member 162 and the second connection member 164 are rotated to separate, and the bent first-directional horizontal member 132 is straightened again between the two vertical columns 112. Importantly, the fixation mechanism 15 is finally engaged with the respective plug hole structure 136 so that the rotation of the first connection member 162 with respect to the second connection member 164 is frozen and thus the corresponding storage shelf 12 is held in the unfolded state.

Further, the first-directional horizontal member 132 can further include a bottom plate 1322 and at least one lateral plate 1324 (two preferably). The two opposing lateral plates 1324 can be produced by bending two sides of the bottom plate 1322 so as to corm a concave accommodation room in between. Similarly, each of the bottom plate 1322 and the lateral plates 1324 are arranged into two separate portions in accordance with the foldable first-directional horizontal member 132. As described above, the first connection member 162 and the second connection member 164 are belonged to two sides of the first-directional horizontal member 132, and the two plug hole structures 136 are respectively arranged to the first connection member 162 and the second connection member 164 and thus can be nested in the accommodation room. When the foldable multi-shelf stand 10 is in a loading application, the accommodation room is faced downward, the plug hole structures 136 are nested inside the accommodation room, and the fixation mechanisms 15 are engaged into the respective plug hole structures 136. Therefore, the connection of the aforesaid elements can be buried in the accommodation room without affecting the appearance of the unfolded stand.

Further, each of the first connection member 162 and the second connection member 164 includes a fixation portion (not shown in the figure) and a connection portion (also not shown in the figure), in which the connection portion is bent from to lateral sides of the fixation portion. The fixation portion of the first connection member 162 is to contact a portion of the bottom plate 1322 of the foldable first-directional horizontal member 132, while the fixation portion of the second connection member 164 is to contact another portion of the bottom plate 1322 of the foldable first-directional horizontal member 132. The connection portion of the first connection member 162 and the connection portion of the second connection member 164 are able to connect tightly with the corresponding lateral plates 1324 of the foldable first-directional horizontal member 132. Also, the connection portions of the first connection member 162 and the second connection member 164 are pivotally connected by, for example but not limited to, riveting.

In this embodiment, the two plug hole structures 136 are constructed to respective fixation portions of the first connection member 162 and the second connection member 164. The configurations of the first connection member 162 and the second connection member 164 are matched to the configuration of the first-directional horizontal member 132, so that the plug hole structures 136 can be well received in the accommodation room without affecting the appearance of the first-directional horizontal member 132.

Further, the width of the connection portion is increased gradually toward the riveted portion. The rivet is mounted at a portion of the connection portion which presents the biggest width, so that the riveting can be easily and the connection strength can be assured.

Referring to FIG. 2, the plug hole structure 136 can be shaped as a semi-cylinder structure. In another embodiment not shown here, a plurality of the same plug hole structures 136 can be separately constructed along the respective fixation portions of the first connection member 162 and the second connection member 164, such that the engagement of the fixation mechanism 15 can be observed through the spacing between the neighboring plug hole structures 136.

Further, the fixation mechanism 15 can include a plug portion 152 and a restraint portion 154 connected angularly with the plug portion 152. In this embodiment shown herein, the restraint portion 154 is perpendicular to the connection portion 152. When the first-directional horizontal member 132 is to unfold, the plug portion 152 is to engage into the plug hole structure 136, while the restraint portion 154 contacts at the plug hole structure 136, such that a fixed relationship is thus formed. Anyhow, even at this stage, the fixation mechanism 15 can be easily disengaged from the plug hole structure 136. By providing the arrangement of the plug hole structure 136 and the fixation mechanism 15, while in achieving the unfolded state of the foldable multi-shelf stand 10, the connection can be swiftly and stably. Further, by proving the plug hole structure 136 to be nested inside the accommodation room, the plug hole structure 136 can be well hidden inside the first-directional horizontal member 132, so that the appearance of the foldable multi-shelf stand 10 won't be affected.

Further, a portion of the foldable first-directional horizontal member 132 can construct a sliding slot 1325 for exposing the restraint portion 154 of the fixation mechanism 15 through the first-directional horizontal member 132. The restraint portion 154 of the fixation mechanism 15 can thus slide along the sliding slot 1325 within the stroke of engaging and disengaging the plug hole structure 136. Upon such an arrangement, the fixation mechanism 15 can then be always held inside the storage shelf 12 and would thus be dropped while in disengaging the plug hole structure 136.

It can be understood that the shape of the plug hole structure 136 can be various but limited only to the feature of facing and extending along the first direction.

It can be understood that the fixation mechanism 15 can be replaced by some other alternatives already existing in the marketplace, such as another fixation mechanism 15 having a diameter at a portion thereof greater than the opening diameter of the plug hole structure 136, such that an obstacle constraint is formed.

Figure 6:
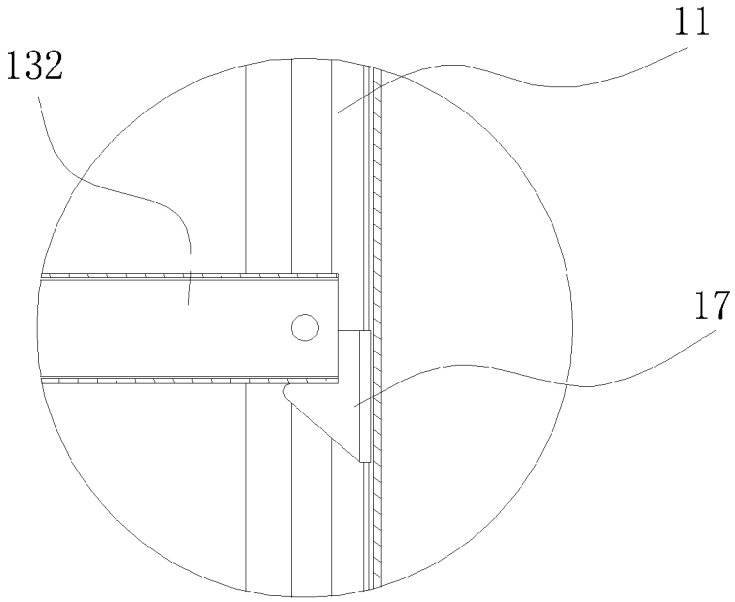
FIG. 6 is another view of FIG. 6.

Referring to FIG. 5 and FIG. 6, the foldable multi-shelf stand 10 can further include a plurality of supportive members 17, each of which is located to the connection place of the first-directional horizontal member 132 and the vertical column 112. The supportive member 17 is pivotally fixed to the first-directional horizontal member 132. In the case that the first-directional horizontal member 132 is moved to the unfolded state, the supportive member 17 is rotated with the first-directional horizontal member 132 and then contacts at the vertical column 112, so that the contact area between the first-directional horizontal member 132 and the vertical column 112 can be increased and thereby the first-directional horizontal member 132 can be evenly stably supported by the vertical column 112.

In details, the supportive member 17 can have a first contact portion 172 and a second contact portion 174, in which the second contact portion 174 is produced from bending up two lateral sides of the first contact portion 172. As the first-directional horizontal member 132 is unfolded, the first contact portion 172 contacts at a portion of the receiving portion 1121 of the vertical column 12, the second contact portion 174 contacts at another portion of the receiving portion 1121. It is obvious that the second contact portion 174 of the supportive member 17 can be shaped as a rectangle, a polygon or any the like that can contact at the vertical column 112. In this embodiment, the second contact portion 174 is shaped to be a triangle.

Figure 3:
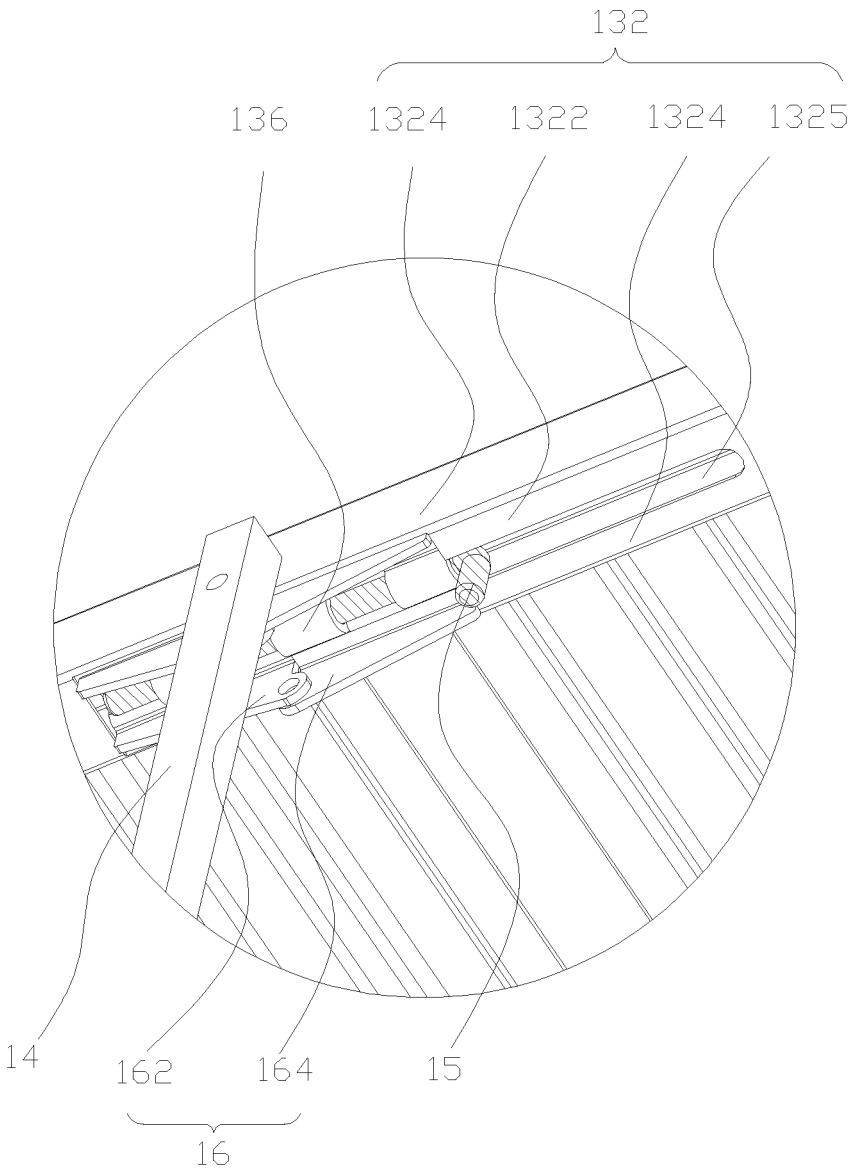
FIG. 3 is another state of FIG. 2.

Referring to FIG. 1 and FIG. 3, the foldable multi-shelf stand 10 can include a plurality of the storage shelves 12, in which the lower three storage shelves 12 are separately and parallel arranged between the two frame structures 11. Apparently, in this embodiment, three storage shelves 12 are included, one at the bottom portion of the frame structures 11, while another two at the middle portion of the frame structures 11. It is understood that the spacing between the neighboring storage shelves 12 between the vertical columns 12 can be adjusted according to various storage purposes.

Further, the storage shelf 12 can further include a storage area 18 encircled by the horizontal members 13. The storage area 18 can be formed by a plate structure, a net structure, or any structure the like. In this embodiment, the storage area 18 is a net structure.

It can be understood that, while the first-directional horizontal members 132 and the second-directional horizontal member 134 is enough for loading the objects, the storage area 18 is not necessary. At this time, multi layers of the formation of the first-directional horizontal members 132 and the second-directional horizontal members 134 along the vertical column 112 are sufficient to serve such a particular loading requirement.

Referring to FIG. 1 and FIG. 4, the foldable multi-shelf stand 10 may include a roof shelf 19. One end of the roof shelf 19 is hinged to the corresponding tops of the vertical columns 112, while another end thereof is rested freely on the corresponding horizontal beam 114 between the respective tops of the vertical columns 112. As the foldable multi-shelf stand 10 is unfolded, the free end of the roof shelf 19 is rested on the corresponding horizontal beam 114 and substantially flush with the top ends of the vertical columns 112. In particular, the roof shelf 19 does not protrude over the horizontal beam 114. On the other hand, while the foldable multi-shelf stand 10 is folded, the roof shelf 19 is rotated in an uncovering manner to the outside of the vertical columns 112 through the hinge connection with the vertical column 112. The free end of the roof shelf 19 is then freely hanged outside the vertical columns 112. As shown in FIG. 1 and FIG. 3, a reinforced column 14 is pivotally connected coaxially to each riveting point that joins the first connection member 162 and the second connection member 164 of each the first-directional horizontal member 132. Upon such an arrangement, the first-directional horizontal members 132 can be folded/unfolded simultaneously, and also the stability of the foldable multi-shelf stand 10 can be upgraded. It is understood that, in some other embodiments, the reinforced column 14 might be removed.

Figure 7:
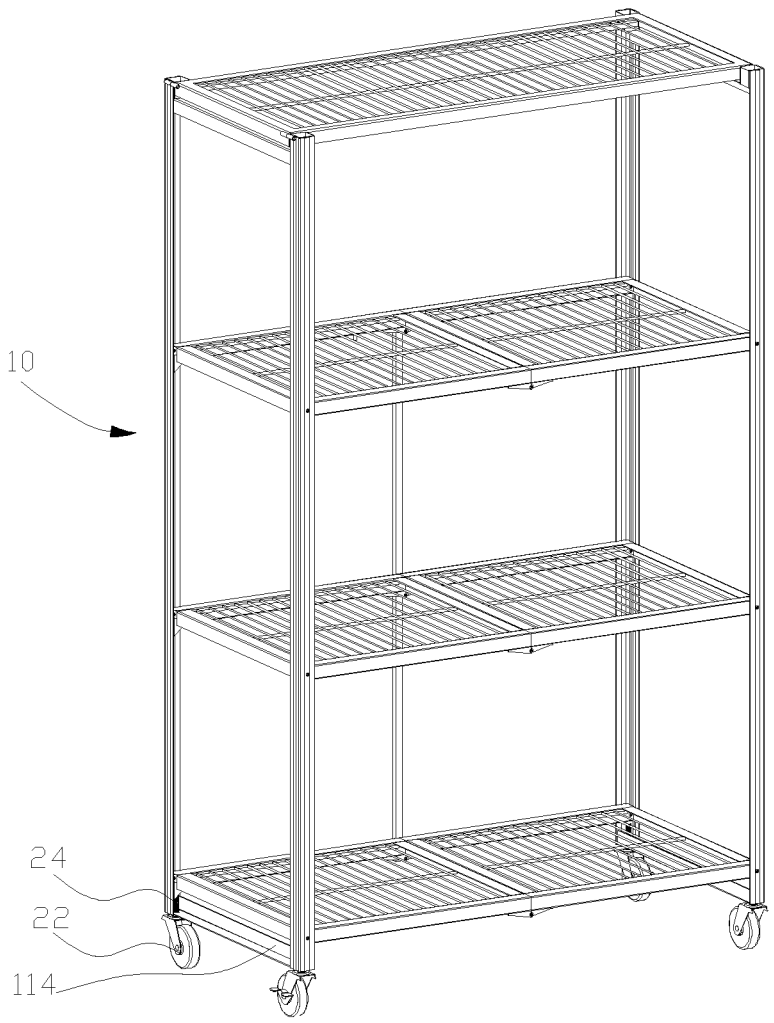
FIG. 7 is an extension application of FIG. 1, in which the foldable multi-shelf stand is equipped with four wheels.

Referring to FIG. 7, an embodiment of the foldable multi-shelf stand with wheels 20 is provided. As shown, the foldable multi-shelf stand 10 is equipped with the wheels or rollers 22, which are mounted to the respective bottom ends of the vertical columns 112, and also fixed to the horizontal beam 114.

Typically, the four wheels 22 is pivotally mounted, in a symmetric manner, to the horizontal beam 114 at the bottoms of the vertical columns 112. By providing these four wheels 22, the stands 10 can then be moved freely.

Further, the foldable multi-shelf stand with wheels 20 may further include a plurality of buffer members 24, each of which is located to the connection of the respective wheel 22 and the horizontal beam 114. While the foldable multi-shelf stand 10 is unfolded, on end of the buffer member 24 can contact the respective second-directional horizontal member 134 connecting the corresponding vertical column 112, while another end thereof is to contact the respective wheel 22, such that a cushion advantage can be obtained while in moving the foldable multi-shelf stand with wheels 20 across an uneven surface.

In this present invention, the first direction as shown in FIG. 1 and FIG. 3 is a transverse direction, while the second direction perpendicular to the first direction is a longitudinal direction. it can be understood that, in some other embodiments, the first direction might not be perpendicular to the second direction.

By providing the foldable multi-shelf stand 10 and the foldable multi-shelf stand 10 with wheels 20 in accordance with the present invention, the foldable first-directional horizontal members 132 and the second-directional horizontal member 134 can be pivotally connected to the respective vertical columns 112, the two plug hole structures 136 can be constructed to discrete sections of the first-directional horizontal member 132 along the first direction. As the first-directional horizontal member 132 is unfolded, the fixation mechanism 15 thereon can mate the corresponding plug hole structure 136, such that the foldable first-directional horizontal member 132 can be fixed in position without any help from the supportive frame or the back ribs and without trading-off the load capacity, structural simplicity and the application convenience.

While the present invention has been particularly shown and described with reference to a preferred embodiment, it will be understood by those skilled in the art that various changes in form and detail may be without departing from the spirit and scope of the present invention.

What is claimed is:

1. A foldable multi-shelf stand, comprising:

two frame structures, each of which has a plurality of vertical columns and a plurality of horizontal beams connected with the plurality of the vertical columns;

a plurality of storage shelves, each of which is separated to two foldable halves, two opposing ends of the storage shelf being pivotally connected to the two frame structures, the storage shelf further including a plurality of horizontal members consisted of a plurality of foldable first-directional horizontal members and a plurality of second-directional horizontal members, two ends of each the first-directional horizontal member being pivotally connected to the respective frame structures;

a plurality of fixation mechanisms, each of which is to mate corresponding plug hole structures constructed respectively at the two halves of each the storage shelf, the fixation mechanism being engaged or disengaged to the corresponding plug hole structure at the respective half of the foldable storage shelf so as to inhibit or allow folding of the storage shelf respectively;

at least one supportive member, located to a respective connection place of the first-directional horizontal member and the frame structure, the supportive member contacting the respective vertical column while the first-directional horizontal member is unfolded; and a connector mechanism consisted of a first connection member and a second connection member, the first connection member and the second connection member being mounted respectively to the two sides of the fordable first-directional horizontal members;

wherein the fixation mechanism further includes a plug portion and a restraint portion, the restraint portion being angularly connected with the connection portion, the plug portion engaging the plug hole structure and the restraint portion contacting the plug hole structure while in unfolding the first-directional horizontal member, a portion of the foldable first-directional horizontal member being constructed with a sliding slot for exposing the restraint portion through the first-directional horizontal member, the restraint portion sliding along the sliding slot within a stroke of engaging and disengaging the plug hole structure; and wherein the first-directional horizontal member further includes a bottom plate and a lateral plate formed by bending up lateral sides of the bottom plate, an accommodation room being formed between the bottom plate and the lateral plate, the first connection member and the second connection member being individually fixedly connected with the two sides of the first-directional horizontal member, the plug hole structure being nested inside the corresponding accommodation room.

2. The foldable multi-shelf stand of claim 1, wherein said second-directional horizontal member pivotally connected with the frame structure, and wherein two of the plug hole structures are located to two sides of the first-directional horizontal member along a first direction.

3. The foldable multi-shelf stand of claim 2, wherein the first connection member being riveted to the second connection member, the two plug hole structures being located respectively to the first connection member and the second connection member.

4. The foldable multi-shelf stand of claim 3, wherein the first-directional horizontal member further includes a bottom plate and a lateral plate formed by bending up lateral sides of the bottom plate, an accommodation room being formed between the bottom plate and the lateral plate, the first connection member and the second connection member being individually fixedly connected with the two sides of the first-directional horizontal member, the plug hole structure being nested inside the corresponding accommodation room.

5. The foldable multi-shelf stand of any of claim 1, wherein the storage shelves are separately and parallel arranged between the two frame structures.

6. The foldable multi-shelf stand of claim 5, further including a roof shelf hinged at one end to one top of one of the two frame structures, while another end thereof is rested freely and flush with one top of another one of the two frame structures.

7. The foldable multi-shelf stand of claim 1, further including a plurality of wheels mounted to bottoms of the two frame structures.

* * * * *